US008046944B2

(12) United States Patent
Nishikawa

(10) Patent No.: US 8,046,944 B2
(45) Date of Patent: Nov. 1, 2011

(54) AUTOMOBILE INTERIOR EXHIBIT

(75) Inventor: Tokuyuki Nishikawa, Toyota (JP)

(73) Assignee: Toyota Boshoku Kabushiki Kaisha, Aichi (JP)

( * ) Notice: Subject to any disclaimer, the term of this patent is extended or adjusted under 35 U.S.C. 154(b) by 89 days.

(21) Appl. No.: 12/469,782

(22) Filed: May 21, 2009

(65) Prior Publication Data

US 2010/0024261 A1 Feb. 4, 2010

(30) Foreign Application Priority Data

Aug. 1, 2008 (JP) ..... 2008-199598

(51) Int. Cl.

| | |
|---|---|
| ***G09F 21/04*** | (2006.01) |
| ***G09F 1/08*** | (2006.01) |
| ***A47G 1/06*** | (2006.01) |
| ***A47G 35/00*** | (2006.01) |
| ***A63G 9/10*** | (2006.01) |
| ***A47C 31/00*** | (2006.01) |
| ***A47C 7/02*** | (2006.01) |
| ***A47C 7/00*** | (2006.01) |
| ***A47C 27/00*** | (2006.01) |

(52) U.S. Cl. ..... 40/593; 40/538; 40/539; 40/800; 297/181; 297/228; 297/452.11; 297/452.48; 297/452.12; 297/452.16; 297/440.14; 297/216.14; 297/216.15; 297/411.24; 297/440.15; 297/225; 297/228.1; 297/227; D20/13; D20/14; 428/542.4; 428/913.3; 428/15; 428/16

(58) Field of Classification Search ..... 40/593, 40/538, 539, 1, 800; 297/181, 228, 452.11, 297/452.48, 452.12, 452.16, 440.14, 216.14, 297/216.15, 411.24, 440.15, 225, 228.1, 297/227; 428/542.4, 913.3, 15, 16; D20/13, D20/14, 134

See application file for complete search history.

(56) References Cited

U.S. PATENT DOCUMENTS

| | | | | |
|---|---|---|---|---|
| 3,348,880 | A * | 10/1967 | Swann | 297/228.13 |
| 7,093,898 | B2 * | 8/2006 | Ladron De Guevara | 297/284.6 |
| 7,131,701 | B1 * | 11/2006 | Yang | 297/452.41 |
| 7,444,701 | B2 * | 11/2008 | Ashley | 5/655 |
| 7,448,681 | B1 * | 11/2008 | Spitzer | 297/228.13 |
| 2003/0066224 | A1 * | 4/2003 | Sumner et al. | 40/593 |
| 2007/0145797 | A1 * | 6/2007 | Itakura | 297/228.1 |

FOREIGN PATENT DOCUMENTS

| | | |
|---|---|---|
| JP | 2003-241670 | 8/2003 |

OTHER PUBLICATIONS

English language Abstract of JP 2003-241670, Aug. 29, 2003.

* cited by examiner

*Primary Examiner* — Joanne Silbermann
*Assistant Examiner* — Syed A Islam
(74) *Attorney, Agent, or Firm* — Greenblum & Bernstein P.L.C.

(57) ABSTRACT

An automobile interior exhibit is configured with a relief formed to replicate an automobile interior member and an interior cover covering the surface of the relief. In the automobile interior exhibit, the relief is provided with a simulative three-dimensional form in perspective so that the relief provides a view from a predetermined viewpoint even when the relief is viewed from the front.

5 Claims, 5 Drawing Sheets

AUTOMOBILE INTERIOR EXHIBIT

CROSS-REFERENCE TO RELATED APPLICATIONS

The present application claims priority under 35 U.S.C. §119 of Japanese Application No. 2008-199598, filed on Aug. 1, 2008, the disclosure of which is expressly incorporated by reference herein in its entirety.

BACKGROUND OF THE INVENTION

1. Field of the Invention

The present invention relates to an automobile interior exhibit configured with a relief formed to replicate an automobile interior member and an interior cover covering the surface of the relief.

2. Description of Related Art

Examples of conventional methods to exhibit a seat cover covering a surface of a pad member of an automobile seat include a known method in which, rather than a seat cover being exhibited alone, the seat cover is exhibited while covering a surface of a relief formed with a semicircular cross section. Specifically, an exhibit configured with a relief having a semicircular cross section and a seat cover covering the surface of the relief is known. Thereby, the seat cover can be exhibited in a manner emphasizing the texture thereof. Aside from the above, the examples of the conventional methods also include a known method in which a surface of a full-scale shape model of an automobile seat is painted to replicate an automobile seat.

Related Art 1 is known as an exemplary background technical reference relating to the present invention.

[Related Art 1] Japanese Patent Laid-open Publication 2003-241670

However, since the relief is formed to have a semicircular cross section in the first-described exhibit, it is difficult for viewers to visualize an actual automobile seat figure. Meanwhile, although this problem (present in the first-described exhibit) is resolved in the second-described exhibit that is configured with a full-scale shape model of an automobile seat formed to replicate an automobile seat, the shape model presents a problem of poor transportability. In order to resolve this problem, the shape model has to be compact. However, the smaller the shape model becomes, the more difficult it becomes to visualize an automobile seat in full-scale.

SUMMARY OF THE INVENTION

The present invention addresses the above-described problems. An advantage of the present invention is to provide an automobile interior exhibit by which an interior cover can be exhibited in a manner that use of the interior cover is visualized, without reducing transportability of the automobile interior exhibit.

In order to achieve the above-described advantage, the present invention provides an automobile interior exhibit having a configuration described below. The present invention described in claim 1 provides an automobile interior exhibit configured with a relief and an interior cover. The relief is formed to replicate an automobile interior member, and the interior cover covers a surface of the relief. The relief is provided with a simulative three-dimensional form in perspective so that the relief provides a view from a predetermined viewpoint even when the relief is viewed from the front. According to the configuration, for example, the relief has a simulative three-dimensional form in two-point perspective with two vanishing points in "width" and "depth" directions among "width", "depth", and "height" directions. Having been formed in the above-described manner, the relief appears three-dimensional in a simulative manner. When the relief is covered with the interior cover, the interior cover can be exhibited in a manner that use of the interior cover is visualized. In addition, by forming the relief in the above-described manner, the thickness of the relief can be reduced. For example, the thickness of the relief can be reduced to approximately 10 cm even when the relief is formed in an approximately full scale of an automobile seat. Thereby, transportability of the automobile interior exhibit can be improved.

The present invention described in claim 2 provides the automobile interior exhibit described in claim 1, in which the relief is dividable at a desired predetermined position. After the division, each relief can be individually covered with the interior cover having different specifications and physical properties. According to the configuration, the reliefs can be easily rearranged in different combinations. For example, even when the reliefs are originally arranged in a single interior cover color, they can be easily rearranged in a combination of different interior cover colors.

The present invention described in claim 3 provides the automobile interior exhibit described in claim 2, in which the relief is formed to replicate an automobile seat that is configured with a seat cushion and a seat back. The relief is configured with a cushion relief that corresponds to the seat cushion and a back relief that corresponds to the seat back. The cushion relief and the back relief are detachable from each other. After the detachment, the cushion relief and the back relief can be individually covered with the interior covers having different specifications and physical properties. According to the configuration, the cushion relief and the back relief can be easily rearranged in different combinations. For example, even when the cushion relief and the back relief are originally arranged in a single interior cover color, they can be easily rearranged in a combination of different interior cover colors.

The present invention described in claim 4 provides the automobile interior exhibit described in claim 3, in which the cushion relief is configured with a seating relief that corresponds to an occupant's seating position and a pair of support reliefs disposed at both sides of the seating relief. The seating relief and the support reliefs are detachable from one another. After the detachment, the seating relief and the support reliefs can be individually covered with the interior covers having different specifications and physical properties. According to the configuration, the seating relief and the support reliefs can be easily rearranged in different combinations. For example, even when the seating relief and the support reliefs are originally arranged in a single interior cover color, they can be easily rearranged in a combination of different interior cover colors.

The present invention described in claim 5 provides the automobile interior exhibit described in claims 3, in which the back relief is configured with a backrest relief that corresponds to an occupant's backrest position and a pair of support reliefs disposed at both sides of the backrest relief. The backrest relief and the support reliefs are detachable from one another. After the detachment, the backrest relief and the support reliefs can be individually covered with the interior covers having different specifications and physical properties. According to the configuration, the backrest relief and the support reliefs can be easily rearranged in different combinations. For example, even when the backrest relief and the support reliefs are originally arranged in a single interior cover color, they can be easily rearranged in a combination of different interior cover colors.

The present invention described in claim 4 provides the automobile interior exhibit described in claims 3, in which an automobile interior relief replicating an automobile interior trim is integrally formed with the relief. According to the configuration, the interior cover colors of the cushion relief and the back relief can be reviewed in relation to the interior cover color of the automobile interior relief.

The present invention described in claim 5 provides the automobile interior exhibit described in claims 1, in which the relief is mounted on a panel member in a manner that a back surface of the relief is detachable from a front surface of the panel member. According to the configuration, the automobile interior exhibit can be easily exhibited and stored.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

First Embodiment

Figure 1:
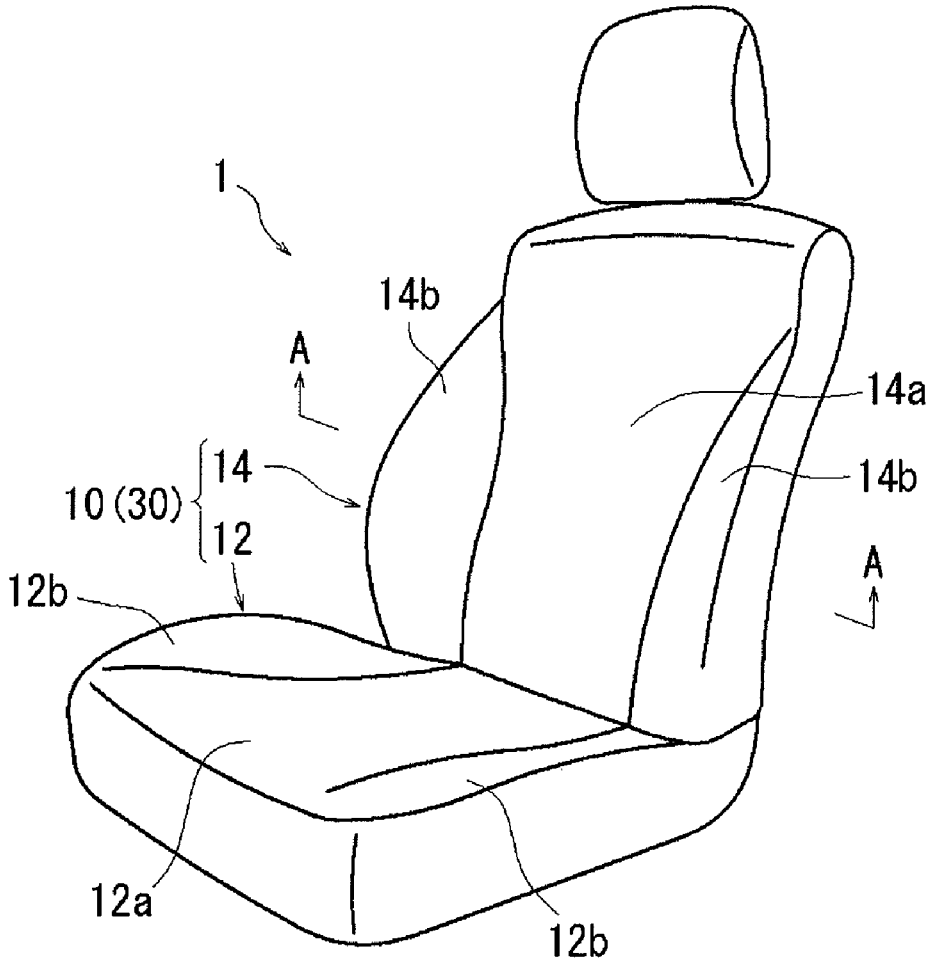
FIG. 1 is a front view of an automobile interior exhibit according to a first embodiment of the present invention.
Figure 2:
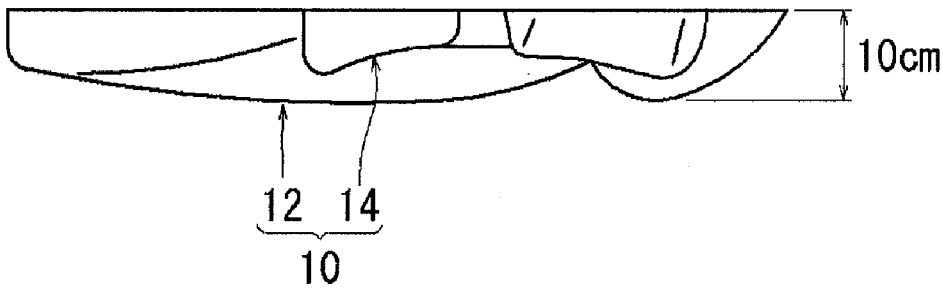
FIG. 2 is a plan view of the automobile interior exhibit of FIG. 1 when viewed from above.
Figure 3:
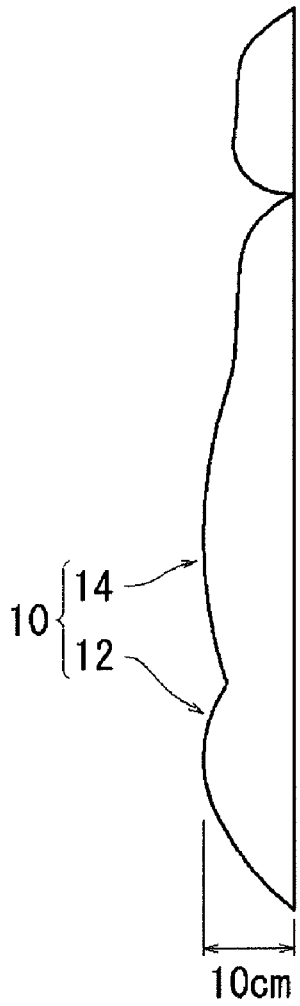
FIG. 3 is a right-side view of the automobile interior exhibit of FIG. 1.
Figure 4:
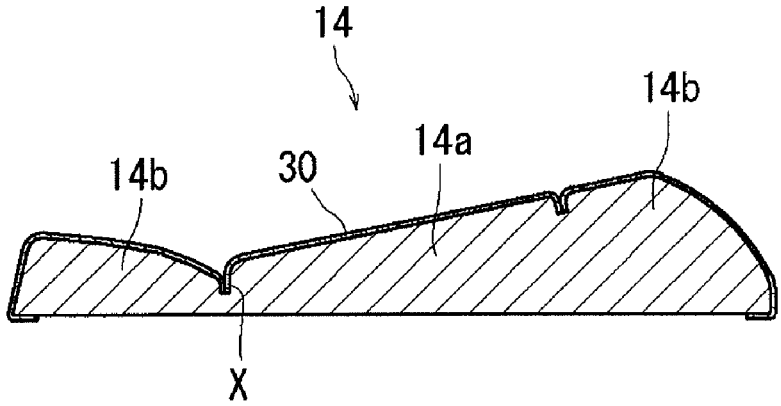
FIG. 4 is a cross-sectional view of the automobile interior exhibit of FIG. 1 taken along line A-A.

A first embodiment of the present invention is explained in the following with reference to FIGS. 1-4. FIG. 1 is a front view of an automobile interior exhibit according to the first embodiment of the present invention. FIG. 2 is a plan view of the automobile interior exhibit of FIG. 1 when viewed from above. FIG. 3 is a right side view of the automobile interior exhibit of FIG. 1. FIG. 4 is a cross-sectional view of the automobile interior exhibit of FIG. 1 taken along line A-A.

As shown in FIG. 1, an automobile interior exhibit 1 of the first embodiment is configured with a relief 10 and a seat cover 30. The relief 10 is formed to replicate an automobile seat, which is an automobile interior member, and the seat cover 30 covers a surface of the relief 10. The relief 10 and seat cover 30 are individually explained below.

The relief 10 is explained first. The relief 10 is formed in an approximately full scale of an automobile seat to replicate the automobile seat configured with a seat cushion and a seat back. Accordingly, the relief 10 is configured with a cushion relief 12 that corresponds to the seat cushion and a back relief 14 that corresponds to the seat back.

The cushion relief 12 and the back relief 14 are explained herein. The cushion relief 12 is configured with a seating relief 12*a* that corresponds to an occupant's seating position and support reliefs. 12*b* and 12*b* disposed at both sides of the seating relief 12*a* in order to support a seated occupant. Meanwhile, the back relief 14 is configured with a backrest relief 14*a* that corresponds to an occupant's backrest position, and support reliefs 14*b* and 14*b* disposed at both sides of the backrest relief 14*a* in order to support an occupant resting his or her back.

The relief 10 has a simulative three-dimensional form in two-point perspective with two vanishing points in "width" and "depth" directions among "width", "depth", and "height" directions. This description corresponds to the description in the claim: "the relief is provided with a simulative three-dimensional form in perspective so that the relief provides a view from a predetermined viewpoint even when the relief is viewed from the front." Having been formed in the above-described manner, the relief 10 appears three-dimensional in a simulative manner without increasing the thickness of the relief 10 even when the relief 10 is viewed from the front. Therefore, even when the relief 10 is formed in an approximately full scale of an automobile seat as described in the present embodiment, the thickness of the relief can be reduced to approximately 10 cm (refer to FIGS. 2 and 3).

The relief 10 is formed in a manner that the surface thereof gradually inclines downward toward the vanishing point in the "width" direction. For example, a surface of the back relief 14 gradually inclines downward from an apex (projecting point) of the support relief 14*b* at the left side (on one's right in FIG. 4) toward a frame groove x of the support relief 14*b* at the right side (on one's left in FIG. 4) (see FIG. 4). Having been formed in the above-described manner, the relief appears more three-dimensional in a simulative manner even when the relief 10 is viewed from the front.

The relief 10 is formed to have a substantially flat back surface. The relief 10 is formed by manually or mechanically notching a block of a resin member, such as foam polystyrene, Chemiwood, and the like, using Numerical Control machining and the like, so that each of the constituting members 12 (12*a* and 12*b*) and 14 (14*a* and 14*b*) can be formed into one piece.

Next, the seat cover 30 is explained. The seat cover 30 is a general-purpose cover member covering the surface of the relief 10. Therefore, the seat cover 30 is prepared in a shape to fit over the relief 10. The seat cover 30 has a configuration that enables the seat cover 30 to cover the surface of the relief 10 while in a tensed condition. Thereby, the seat cover 30 can neatly cover the surface of the relief 10. The automobile interior exhibit 1 is configured with the relief 10 and seat cover 30.

The automobile interior exhibit 1 according the first embodiment of the present invention has the above-described configuration. According to the configuration, the relief 10 is formed to replicate an automobile seat. The relief 10 has a simulative three-dimensional form in two-point perspective with two vanishing points in "width" and "depth" directions among "width", "depth", and "height" directions. Having been formed in the above-described manner, the relief 10 appears three-dimensional in a simulative manner even when it is viewed from the front. Therefore, when the relief 10 is covered with the seat cover 30, the seat cover 30 can be exhibited in a manner that use of the seat cover is visualized. In addition, by forming the relief 10 in the above-described manner, the thickness of the relief 10 can be reduced. Even when the relief 10 is formed in an approximately full scale of an automobile seat as described in the present embodiment, the thickness of the relief can be reduced to approximately 10 cm. Thereby, transportability of the automobile interior exhibit 1 can be improved. In short, the automobile interior exhibit 1 can be easily transported.

Second Embodiment

Figure 5:
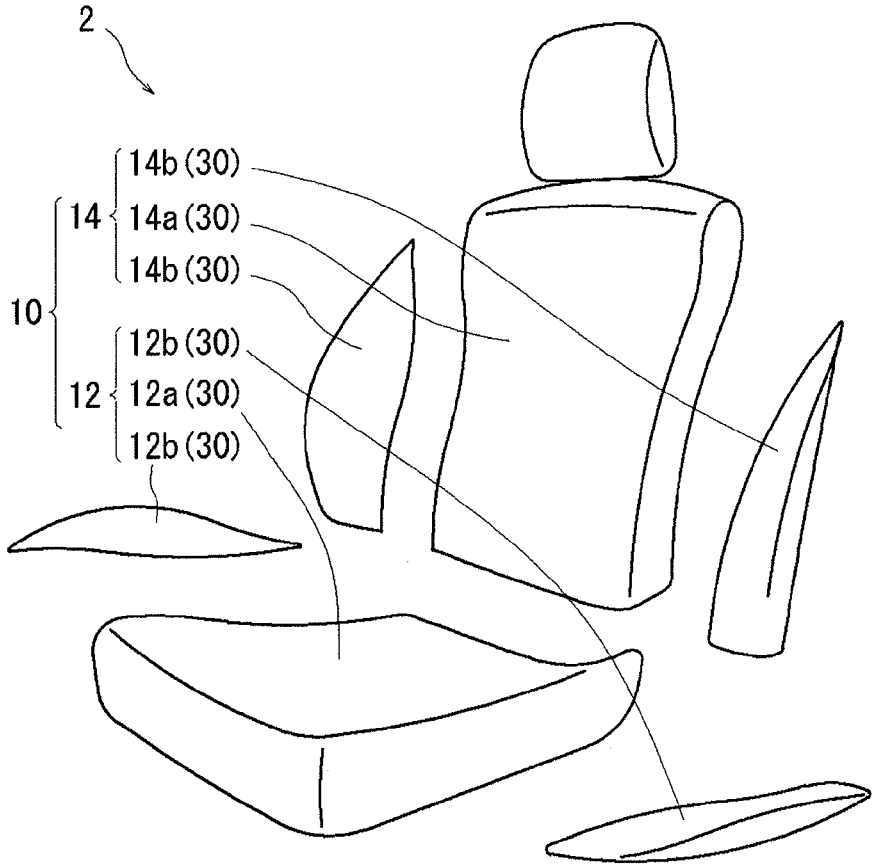
FIG. 5 is an exploded front view of an automobile interior exhibit according to a second embodiment of the present invention.

A second embodiment of the present invention is explained in the following. FIG. 5 is an exploded front view of an automobile interior exhibit according to the second embodiment of the present invention.

Compared to the automobile interior exhibit 1 described in the first embodiment, an automobile interior exhibit 2 according to the second embodiment is different in that constituting members 12 (12*a* and 12*b*) and 14 (14*a* and 14*b*) of the relief 10 are detachable from one another. In the description below, the constituting members that are equivalent or identical to those described in the first embodiment are denoted by the same reference numerals, and thus description thereof will be hereinafter omitted. The same applies to third and fourth embodiments that are to be later described.

As shown in FIG. 5, the relief 10 is dividable into two portions: the cushion relief 12 and the back relief 14. This description corresponds to the description in the claim: "the relief is dividable at a desired predetermined position." A projection (not shown) is formed on an edge of the cushion relief 12 adjoining the back relief 14. A recess (not shown) is formed in an edge of the back relief 14 adjoining the cushion relief 12. The projection can be fitted into the recess. The cushion relief 12 and the back relief 14 may be individually covered with the seat covers having different specifications (e.g., a different color) and physical properties (e.g., different material).

Similar to the above, the cushion relief 12 is dividable into three portions: the seating relief 12*a* and the pair of support reliefs 12*b*. After the division, the seating relief 12*a* and the pair of support reliefs 12*b* may be individually covered with the seat covers having different specifications and physical properties. Similarly, the back relief 14 is dividable into three portions: the backrest relief 14*a* and the pair of support reliefs 14*b*. After the division, the backrest relief 14*a* and the pair of support reliefs 14*b* can be individually covered with the seat covers having different specifications and physical properties.

The automobile interior exhibit 2 according to the second embodiment of the present invention has the above-described configuration. According to the configuration, the constituting members 12 (12*a* and 12*b*) and 14 (14*a* and 14*b*) are detachable from one another. Therefore, the cushion relief 12 and the back relief 14 can be easily rearranged in different combinations. Specifically, even when the cushion relief 12 and the back relief 14 are originally arranged in a single seat cover color, they can be easily rearranged in a combination of different colors. The same applies to the seating relief 12*a* and the pair of support reliefs 12*b* as well as the backrest relief 14*a* and the pair of support reliefs 14*b*.

Third Embodiment

Figure 6:
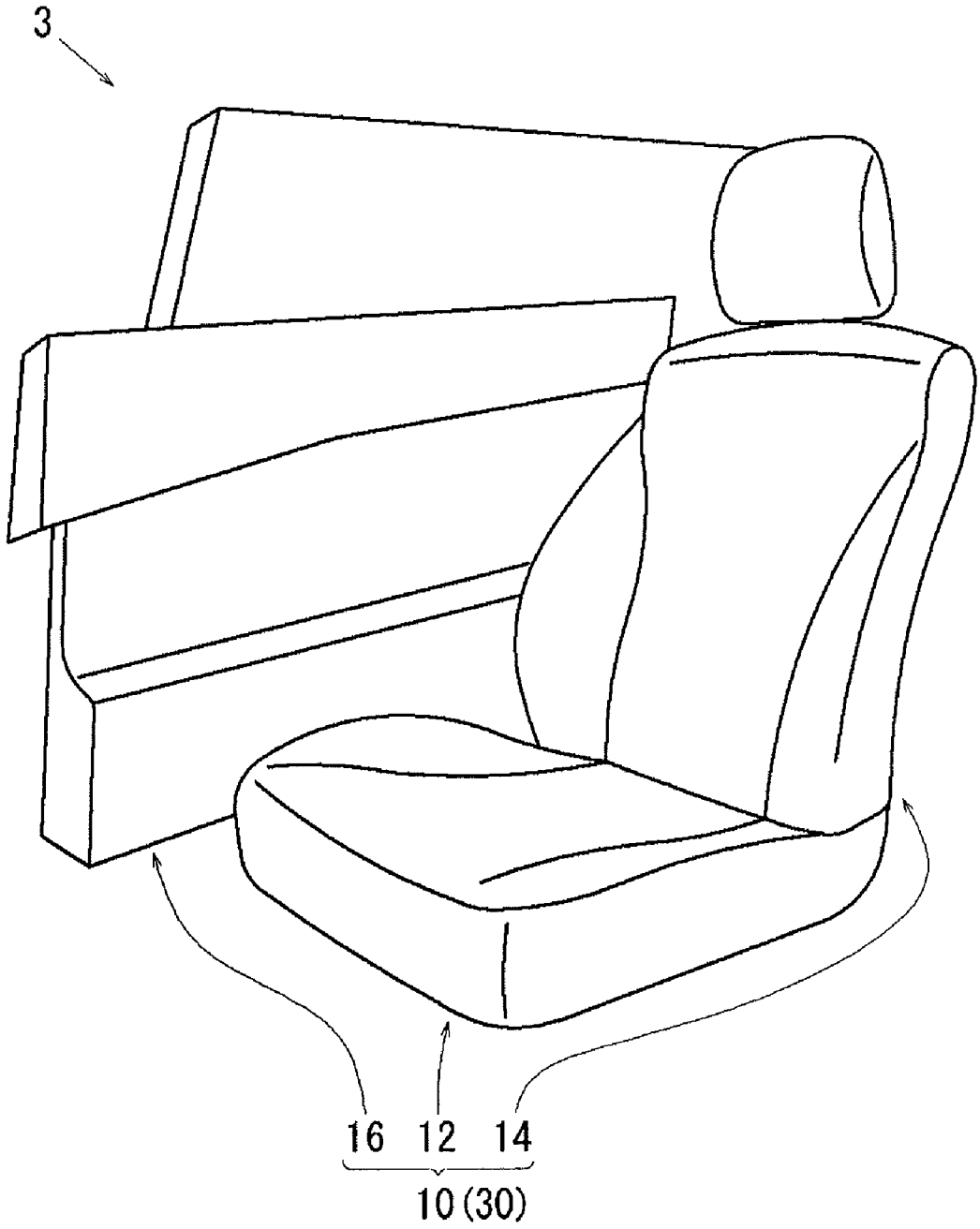
FIG. 6 is a front view of an automobile interior exhibit according to a third embodiment of the present invention.

The third embodiment of the present invention is explained in the following. FIG. 6 is a front view of an automobile interior exhibit according to the third embodiment of the present invention.

Compared to the automobile interior exhibit 1 described in the first embodiment, an automobile interior exhibit 3 according to the third embodiment is different in that the relief 10 is formed to replicate automobile interior space in addition to an automobile seat.

As shown in FIG. 6, an automobile interior relief 16 replicating an automobile interior trim is integrally formed with the relief 10 so that an automobile interior trim adjoins an automobile seat. Similar to the cushion relief 12 and the back relief 14, the automobile interior relief 16 has a simulative three-dimensional form in two-point perspective, and a surface thereof is covered with the seat cover 30.

The automobile interior exhibit 3 according to the third embodiment of the present invention has the above-described configuration. According to the configuration, the automobile interior relief 16 replicating an automobile interior trim is integrally formed with the relief 10. Thereby, the colors of the seat covers 30 of the cushion relief 12 and the back relief 14 can be reviewed in relation to the color of the seat cover 30 of the automobile interior relief 16.

Fourth Embodiment

Figure 7:
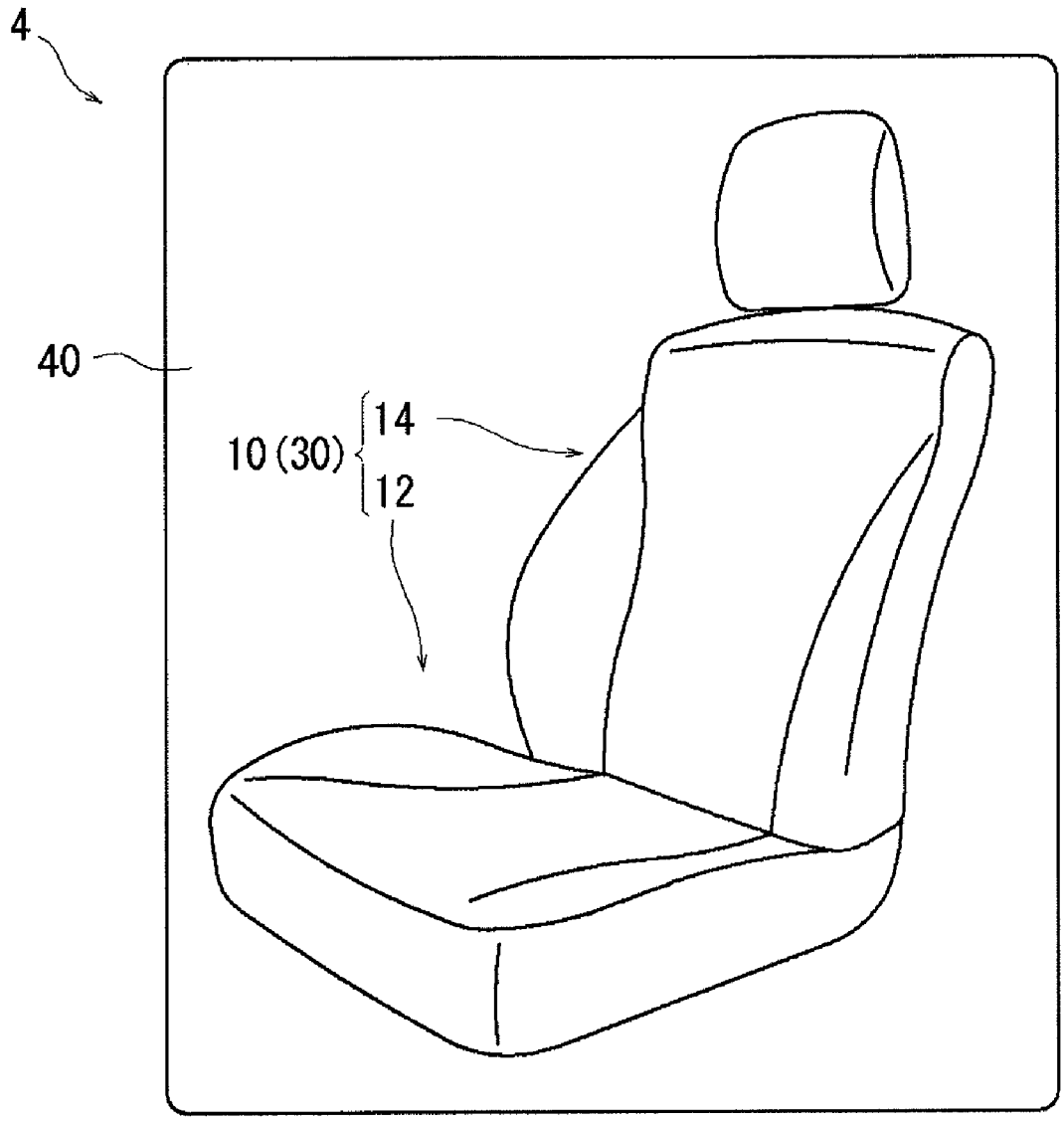
FIG. 7 is a front view of an automobile interior exhibit according to a fourth embodiment of the present invention.

Lastly, the fourth embodiment of the present invention is explained in the following. FIG. 7 is a front view of an automobile interior exhibit according to the fourth embodiment of the present invention.

Compared to the automobile interior exhibit 1 described in the first embodiment, an automobile interior exhibit 4 according to the fourth embodiment is different in that the relief 10 is mounted on a panel member 40.

As shown in FIG. 7, the relief 10 is mounted on the panel member 40 so that the back surface thereof faces a front surface of the panel member 40. A configuration of the assembly is such that the panel member 40 is provided with a through hole (not shown) for a bolt (not shown), into which the bolt is inserted from a back surface of the panel member 40, and that the relief 10 is threadably mounted on the panel member 40 with the bolt inserted into the through hole. The relief 10 can be easily dismounted from the panel member 40 by removing the bolt.

The automobile interior exhibit 4 according to the fourth embodiment of the present invention has the above-described configuration. According to the configuration, the relief 10 is mounted on the panel member 40 in a manner that the back surface thereof is detachable from the front surface of the panel member 40. Thereby, the automobile interior exhibit 4 can be easily stored and exhibited.

The above descriptions are for exemplary purposes only, and the present invention is not limited by any of the above descriptions. In each of the embodiments, an example in which the relief 10 has a simulative three-dimensional form in two-point perspective with two vanishing points in "width" and "depth" directions among "width", "depth", and "height" directions is described. However, the present invention is not limited to the same, and the relief 10 may have a simulative three-dimensional form in one- or three-point perspective.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. An automobile interior exhibit comprising: a relief formed to replicate an automobile interior member, the relief comprising a flat surface and a form projecting from the flat surface, and a panel, the relief mounted on the panel with the flat surface contacting the panel for the purpose of mounting the panel and the relief on a wall; and an interior cover configured to cover a surface of the relief, wherein the relief is provided with a simulative three-dimensional form in perspective so that the relief provides a view from a predetermined viewpoint even when the relief is viewed from the front, wherein the relief is dividable at a desired predetermined position and, after the division, each relief can be individually covered with the interior cover having different specifications and physical properties, wherein the relief is formed to replicate an automobile seat configured with a seat cushion and a seat back, and is configured with a cushion relief that corresponds to the seat cushion and a back relief that corresponds to the seat back, wherein the cushion relief and the back relief are detachable from each other, and, after the detachment, the cushion relief and the back relief can be individually covered with the interior covers having different specifications and physical properties.

2. The automobile interior exhibit according to claim 1, wherein the cushion relief is configured with a seating relief that corresponds to an occupant's seating position and a pair of support reliefs disposed at both sides of the seating relief, wherein the seating relief and the support reliefs are detachable from one another, and, after the detachment, the seating relief and the support reliefs can be individually covered with the interior covers having different specifications and physical properties.

3. The automobile interior exhibit according to claim 1, wherein the back relief is configured with a backrest relief that corresponds to an occupant's backrest position and a pair of support reliefs disposed at both sides of the backrest relief, wherein the backrest relief and the support reliefs can be detachable from one another, and, after the detachment, the backrest relief and the support reliefs can be individually covered with the interior covers having different specifications and physical properties.

4. The automobile interior exhibit according to claim 1, wherein an automobile interior relief replicating an automobile interior trim is integrally formed with the relief.

5. The automobile interior exhibit according to claim 1, wherein the relief is mounted on the panel in a manner that a back surface of the relief is detachable from a front surface of the panel member.

* * * * *